US007166029B2

(12) United States Patent
Enzminger

(10) Patent No.: US 7,166,029 B2
(45) Date of Patent: Jan. 23, 2007

(54) CURVED SURFACE DISPLAY FOR A GAMING MACHINE

(75) Inventor: Joseph R. Enzminger, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 10/985,362

(22) Filed: Nov. 10, 2004

(65) Prior Publication Data

US 2006/0100013 A1 May 11, 2006

(51) Int. Cl.
*A63F 9/24* (2006.01)

(52) U.S. Cl. ..... 463/20; 273/143 R

(58) Field of Classification Search ..... None
See application file for complete search history.

(56) References Cited

U.S. PATENT DOCUMENTS 4,912,389 A * 3/1990 Eguchi ..... 318/696
5,839,957 A * 11/1998 Schneider et al. ..... 463/20
2003/0060269 A1 3/2003 Paulsen et al.
2004/0266515 A1 12/2004 Gaulsemann

* cited by examiner

*Primary Examiner*—Mark Sager
(74) *Attorney, Agent, or Firm*—The Culbertson Group, P.C.

(57) ABSTRACT

A result presentation arrangement for a slot machine includes a display having a display surface forming generally at least a portion of a curved shape. A processor is coupled to communicate with the display to cause the display to produce or display one or more indicia and to control movement or animation of the indicia. One or more curved displays may be mounted on a spinnable reel, or one or more curved displays may be supported in a stationary position and controlled to simulate one or more spinning reels.

16 Claims, 3 Drawing Sheets

CURVED SURFACE DISPLAY FOR A GAMING MACHINE

TECHNICAL FIELD OF THE INVENTION

This invention relates to electronic gaming system displays. More particularly, the invention is directed to apparatus and methods for games in which a player may view images being displayed on a curved surface in, for example, a reel-type apparatus.

BACKGROUND OF THE INVENTION

Traditional mechanical slot machines include three or four reels rotatably mounted on a common axis. Each reel has different indicia spaced around its periphery. The indicia may be pictures of bells, bars, fruit, or any number of other symbols to suit a particular theme for the slot machine. Lines that are formed along a number of reel locations are referred to as "paylines." For example, a payline may be formed parallel to the common axis. In operation, a player makes a wager concerning a given payline, and then pulls a handle on the mechanical slot machine to spin the reels. The indicia that line up along the payline when the reels stop spinning represents a result for the payline. Different sets of indicia on the payline represent different results for the player.

In some mechanical reel slot machines, a result for a given play of the game may be generated by a random result generator associated with the slot machine and each reel may be forced to stop spinning at the appropriate position to show the proper set of indicia along the payline for the result. Alternatively, the spinning reels are otherwise randomly stopped or are allowed to stop at various positions and the stop positions themselves determine the indicia that line up along a given payline to represent a result for the play. In either case, the indicia that line up along a payline when the reels stop spinning determine or indicate the result associated with the play and correlate to any prize for the result.

The vertically oriented reels in a typical mechanical slot machine are placed behind a glass plate with the indicia on the periphery of the reels facing the player position. The diameter of the reels is commonly such that three adjacent indicia on each reel face the player position so that a player in that position may see all three adjacent indicia on each reel. Where three adjacent indicia on each reel are visible to the player, the slot machine may have three horizontal paylines. Other three reel slot machines have three horizontal paylines, three vertical paylines, and two diagonal paylines for a total of eight different paylines. Yet other slot machines may define angled paylines through the various indicia positions visible to the player facing the gaming machine.

Mechanical reel-type gaming machines present a number of problems. For example, a mechanical reel-type gaming machine is prone to break down due to the mechanical nature of the device. In addition, mechanical reel-type machines do not offer an easy way to change the appearance of the gaming machine. For these reasons, manufacturers of mechanical reel-type gaming machines have reduced the number of mechanical components in the reel-type gaming machines. In particular, many modem slot machines replace the mechanical reels with a video display that is driven to simulate spinning reels. These electronic versions of reel-type gaming machines offer flexibility in modifying reel indicia and reduce the number of mechanical components in the mechanical reel-type gaming machines. However, among other problems, prior video gaming machines that imitate mechanical reel-type gaming machines may not look realistic depending upon the quality of the video display and the graphics processing arrangement associated with the gaming machine.

SUMMARY OF THE INVENTION

The present invention provides apparatus and methods for producing reel-type presentations and displaying gaming results. In particular, the present invention provides apparatus and methods for producing realistic reel-type presentations while achieving the flexibility of video reel-type presentations.

An apparatus according to one preferred form of the invention includes a graphic presentation arrangement for a gaming machine. The graphic presentation arrangement includes a display device forming a portion of a substantially cylindrical shape. The apparatus also includes a processing device operatively connected to the display device to cause the display device to produce a desired graphic image. In one embodiment, the curved display is fixed in place, but is driven to simulate a spinning reel of a slot machine. Due to the curvature of the display device, the fixed display device may present a high quality simulation of actual spinning reels.

A method according to one preferred form of the invention includes displaying a gaming result on a display device. The gaming result may be represented by a set of indicia displayed on the display device. The display device is driven by a graphics processor to produce at least one indicia in the set of indicia, and the display device forms a portion of a substantially cylindrical shape such that the display device imitates reels of a mechanical slot machine.

Another gaming machine according to the present invention includes one or more spinnable reels with one or more displays located on a portion of the peripheral surface of the respective reel. Each display is capable of independently displaying one or more respective indicia. This alternate form of gaming machine also includes a processor that is coupled to communicate with each of the displays and to control the images produced by the different displays. By providing one or more controllable displays on the periphery of a reel in a reel-type gaming machine, this form of the present invention adds flexibility in displaying results with the gaming machine, while retaining the general look and mechanical action of a mechanical reel slot machine.

These and other advantages and features of the invention will be apparent from the following description of the preferred embodiments, considered along with the accompanying drawings.

DESCRIPTION OF PREFERRED EMBODIMENTS

Figure 1:
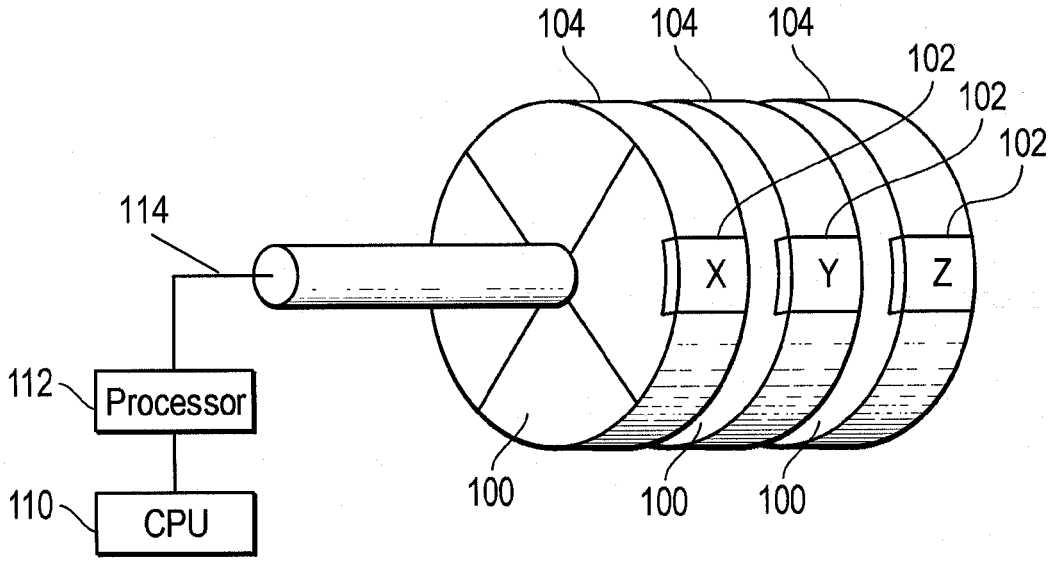
FIG. 1 is a somewhat diagrammatic perspective view showing three reels of a reel-type gaming device according to principles of the present invention.

FIG. 1 shows three reels 100 for a reel-type gaming device according to principles of the present invention. Each of the three reels 100 is shown with a curved display 102 such as a flexible liquid crystal display (LCD) mounted on a portion of the curved surface 104 making up the periphery of the respective reel. Each of the curved displays 102 is illustrated displaying an indicia. A first one of the curved displays 102 shows the indicia "X," a second one of the curved displays shows the indicia "Y," and a third one of the curved displays shows the indicia "Z." It should be appreciated that the curved displays 102 may display indicia other than the illustrated indicia such as bells, cherries, bars, or any other images suitable for use in reel-type gaming machines. Although not shown in FIG. 1 to simplify the drawing, it will be appreciated that in addition to the displays 102, various static indicia are portrayed at different locations along the peripheral surface 104 of each respective reel to form, together with the respective display 102, a generally continuous set of indicia locations along the respective peripheral surface 104. In addition to the three reels 100, FIG. 1 also shows a processing device (CPU) 110 for the reel-type gaming device in which reels 100 may be included. Processing device 110 is illustrated having a dedicated graphics processing device 112 for producing the instructions and signals necessary to cause displays 102 produce the desired graphics or indicia.

When a player activates a gaming machine in which reels 100 are included, either by pulling a lever, pushing a "PLAY" button, or operating some other activating device, reels 100 are actually caused to spin about their common axis. There are many alternate arrangements that may be used in a gaming machine to cause reels such as reels 100 to spin and then ultimately stop so that various indicia shown on the peripheral surface 104 of each reel align along one or more paylines defined for the gaming machine. These reel spinning and control arrangements form no part of the present invention and are thus not described here in detail. However, it will be appreciated by those skilled in the art of reel-type gaming machines that a suitable reel spinning arrangement may include a mechanical linkage between a player actuating lever and the reels. Alternatively, reels may be caused to spin by one or more motors preferably operated under the control of CPU 110 or some other suitable controller.

According to the present invention, one or more processing devices such as CPU 110, or the CPU combined with one or more dedicated graphics processors such as processor 112 drive each of the curved displays 102. In one preferred embodiment, a main processing device such as CPU 110 cooperates with a separate graphics processor 112 for each curved display 102 or for each of a number of limited groups of curved displays. Such a graphics processor may be located externally to the respective spinnable reel 100, or internally to the respective reel. Regardless of whether the images displayed on curved displays 102 are controlled through a single main processing device such as CPU 110 or the CPU in coordination with one or more dedicated graphics processors, the image or indicia displayed at each curved display 102 may include continuous or intermittent animations or may change or remain constant during the course of a play at the gaming machine including reels 100.

It will be appreciated from the above description that electrical signals must ultimately be communicated from a stationary device located off of reels 100 to the display devices 102 mounted on the spinnable reels 100. The line 114 represents a portion of a communication link between graphics processor 112 and spinnable reels 100. This communication link 114 carries signals from graphics processor 112 to spinnable reels 100 for driving displays 102. Even if all of the processing elements are located on a respective spinnable reel 100, electrical power must be supplied to the respective processing elements for long term operation. Any electrical signals that must be delivered to some element located on one of the spinnable reels 100 may be communicated with a suitable slip ring arrangement that maintains the required electrical contact while still allowing the respective reel 100 to spin as desired. Although data may be communicated to processing elements on the spinning reels 100 in a wireless fashion, power to any such processing elements may be supplied through a suitable slip ring arrangement. Those of ordinary skill in the art and viewing the present disclosure will appreciate the different manners for power signals and data to be delivered to electrical elements such as displays 102 mounted on spinnable reels 100.

FIG. 1 shows a single curved display 102 on each reel 100, with the curved display spanning only a single reel indicia location. Other forms of the invention may include a longer curved display such as display 102 that spans two or more adjacent indicia locations about the peripheral surface of the respective reel. Each such location on a longer single display may be driven to show a separate indicia, or a single indicia may span two or more indicia locations.

Figure 2:
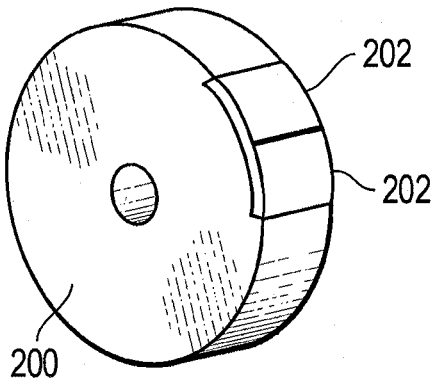
FIG. 2 is a perspective view showing another type of reel for a reel-type gaming device.

As shown in FIG. 2, an alternate arrangement according to the invention may include a reel 200 having multiple distinct curved displays 202. Although two adjacent displays 202 are shown in FIG. 2, it will be appreciated that the multiple distinct displays 202 may be spaced apart at different locations around the peripheral surface of reel 200. As with FIG. 1, FIG. 2 omits the standard static graphic indicia located at locations of the reel peripheral surface not occupied by displays 202. These static graphics will commonly be present on a reel 200 in order to make the reel suitable for use in a gaming machine. Also, as described above in connection with displays 102, displays 202 are driven or controlled through a suitable processing arrangement to display various animated or non-animated indicia, and to change the displayed indicia in any way desired during the course of a game play or over the course of multiple game plays at a gaming machine including reel 200.

Figure 3:
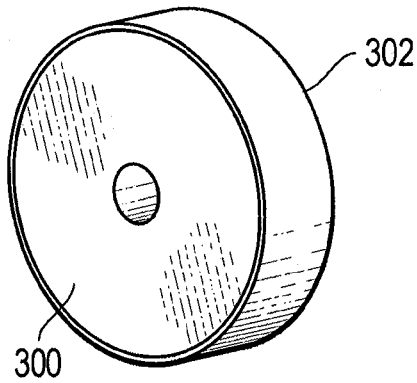
FIG. 3 is a perspective view of yet another type of reel for a reel-type gaming device.

FIG. 3 shows yet another type of reel 300 according to the invention for use in a reel-type gaming device. In the embodiment of FIG. 3, reel 300 includes a curved display 302 extending around the entire peripheral, cylindrical reel surface. It will be appreciated that in this form of the invention, display 302 must be driven or controlled to provide or show the desired indicia (if any) at each indicia location on the peripheral surface of reel 300. As in the embodiments described above with reference to FIG. 1, curved display 302 on reel 300 may be driven or controlled by any suitable processing device or combination of processing devices to display the desired graphics or indicia in the course of a reel-type game, or between games. Electrical power and/or signals for causing curved display 302 to show the desired graphic or graphics may be communicated to the curved display via one or more slip ring arrangements associated with reel 300.

It should be noted that displays 102, 202, and 302 shown in FIGS. 1, 2, and 3, respectively, are shown with a certain thickness. This display thickness is exaggerated for purposes of illustration and clarity in the drawings. It will be appreciated that an actual curved display device that may be employed according to the invention may have a lesser or greater thickness relative to the size of the respective reel. Regardless of the actual thickness of the display device, the display device includes a display surface and it is this display surface that approximates or forms a portion of a cylindrical shape according to the present invention, and shows the desired indicia or other graphic elements. The curved display or displays used on a gaming machine reel according to the invention may be supported by the reel in any suitable fashion. In some forms of the invention, a display may be self-supporting in the desired curved shape and the reel structure simply supports the curved display at the desired location so that the curved display surface forms the desired portion of the desired cylindrical surface.

Figure 4:
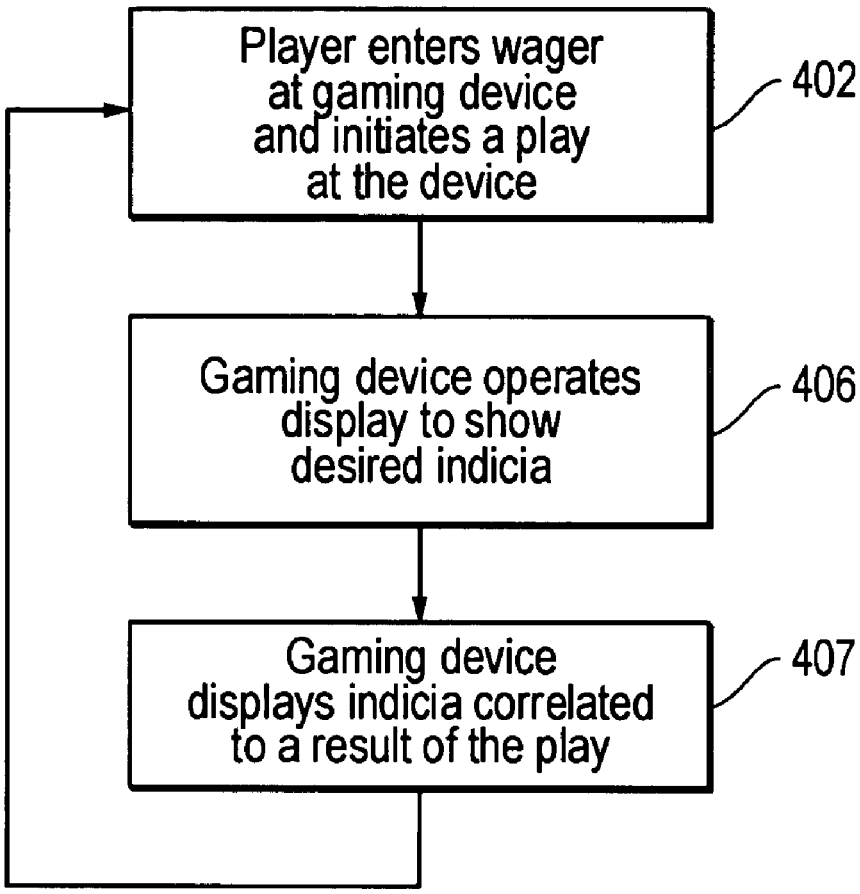
FIG. 4 is a flow diagram illustrating a gaming method embodying principles according to the present invention.

The flow diagram of FIG. 4 illustrates a gaming method 400 embodying principles according to the present invention that may be performed in a gaming machine using any of the reels shown in FIGS. 1 through 3. At process block 402 a player enters a wager via a suitable interface at the gaming machine and initiates a play at the gaming machine by pulling a handle associated with the machine, or pressing a button, or activating some other input device at the gaming machine.

At process block 406, the gaming device may light or otherwise drive the curved display or displays 102, 202, or 302 to show or produce the desired indicia at the reel location or locations encompassed by the respective display. Ultimately, the gaming device displays a series of indicia correlated to a result of the play as indicated at process block 407. This series of indicia correlated to a result for the play will commonly be associated with a payline defined for the gaming machine. The indicia shown on a curved display according to the invention may be included on a payline for the gaming machine and thus help show a result to the player. For the displays 102 and 202, the indicia shown by the displays may or may not form part of a payline and thus may or may not show any result. However, since the curved display 302 extends around the entire reel 300, such a display would normally show at least one of the indicia making up a payline for a gaming machine using such a reel.

It will be noted that curved displays 102, 202, and 302 each provide an opportunity for producing interesting effects and/or interesting game characteristics at a gaming machine using such displays. As one example, the indicia presented or shown by one of the curved displays at any given reel location may be animated, rather than static. Also, it is possible for the indicia to be changed during the course of play. For example, the gaming machine or some element associated with the gaming machine using a curved display according to the invention may determine a result that correlates to a given series of indicia to be displayed. However, a different, non-winning series of indicia may initially be displayed, including an indicia at a curved display, and then the indicia at the curved display may be changed to show the correct series of indicia for the play result.

The curved displays and reels using such curved displays according to the present invention are not limited to use in gaming machines employing any particular result determination technique. Rather, any suitable result determining technique may be used by a gaming machine incorporating curved displays according to the invention. It will be appreciated, however, that the full advantages of the curved displays, such as displays 102, 202, and 302, are best achieved in a gaming machine in which the result of a game play is determined according to some algorithm or some random or pseudo-random result generation technique either performed at the gaming machine or at some element in a gaming system including the gaming machine. For example, the result for a given game play may be determined by a result in a lottery game, a bingo game, or some other type of game.

Figure 5:
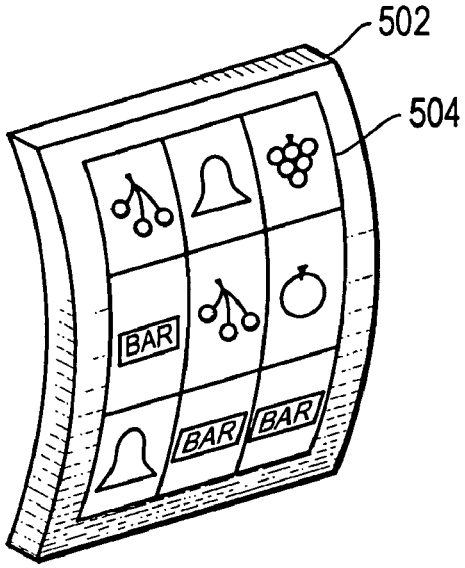
FIG. 5 is a perspective view of a stationary curved display which may be driven to simulate spinning reels according to principles of the present invention.

FIG. 5 is a perspective view of a stationary curved shape 502 that includes a curved display 504. The curved shape 502 and display 504 are stationary in the sense that they do not themselves spin or otherwise move relative to a gaming machine on which they may be mounted. In this embodiment of the invention, images are generated on the display surface of the curved display 504 to imitate, in the illustrated example, three separate spinning reels. That is, display 504 is driven by a suitable processing arrangement such as that described above with reference to FIG. 1 to cause indicia move or appear to move across the curved display 504 to imitate spinning reels. The simulation of spinning reels ultimately shows that the indicia stop in a desired position to show a result of a play to the player. As with the displays 102, 202, and 302 described above, curved display 504 may be a flexible LCD. Also as with the previously disclosed types of curved displays, display 504 is not limited to use with any particular type of result determination method or arrangement. The result in the game need only be correlated in some fashion with a series of indicia to be displayed and display 504 need only be driven in some suitable fashion to show or display the series of indicia to the player. In a preferred form of gaming machine including a curved display such as display 504, some element would determine a game play result, a suitable set of indicia and indicia locations would be looked up or otherwise determined to represent the result, and then instructions would be provided through a suitable processing arrangement to cause curved display 504 to show or display that set of indicia in the required locations.

In the embodiment of FIG. 5, display 504 may be self supporting in the desired curved position to approximate or match a portion of a cylindrical surface. In this case, no surface 502 may be required and the curved display may be supported only by some suitable number of contact or support points in a gaining machine. However, other forms of the invention may require that surface 502 actually support the display 504 in the desired curved position.

Figure 6:
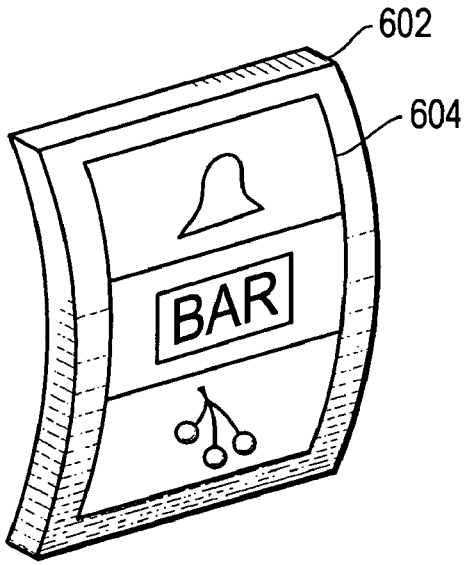
FIG. 6 is a perspective view similar to FIG. 5, but showing a single reel simulated on the curved display.

FIG. 6 is a perspective view of yet another embodiment for a stationary curved shape 602 and display 604. Curved display 604 preferably matches or approximates a portion of a cylindrical surface, as with the previously described embodiments. Display 604 may be used alone, or several of such displays shown in FIG. 6 may be used together to form a game presentation arrangement that simulates a multiple reel gaming machine. As with the embodiment in FIG. 5, display 604 may be self supporting in the desired curved position, or such a display may be supported by the underlying curved shape 602.

As will become apparent to one of ordinary skill in the art and viewing the disclosed embodiments, further variations for use of a flexible display such as an LCD in a gaming machine are possible and are within the scope of the appended claims. The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A graphic presentation arrangement for a gaming machine, the graphic presentation arrangement including:

(a) a display device forming a portion of a substantially cylindrical shape, the display device being supported by a support structure that is mounted for rotation on the gaming machine; and (b) a communication link for carrying signals in a wireless fashion between the support structure and a stationary device located off of the support structure, the signals being associated with causing the display device to produce a graphic image.

2. The graphic presentation arrangement of claim 1 further including a graphics processor mounted on the support structure, the graphics processor for producing an output causing the display device to produce the graphic image.

3. The graphic presentation arrangement of claim 1 further including a graphics processor mounted on the gaming machine separate from the support structure, the graphics processor for producing an output causing the display device to produce the graphic image.

4. The graphic presentation arrangement of claim 1 wherein the display device includes a flexible liquid crystal display.

5. An apparatus including:

(a) a display device forming at least a portion of a graphic presentation arrangement for presenting a gaming result to a player, the display device forming a portion of a substantially cylindrical shape and being mounted on a support structure that is rotatable with respect to a separate portion of the apparatus; and (b) a communication link for carrying signals in a wireless fashion between the support structure and the separate portion of the apparatus, the signals being associated with causing the display device to produce a graphic image.

6. The apparatus of claim 5 further including at least one additional display device forming another portion of the graphic presentation arrangement for presenting the gaming result to the player, the display device and the at least one additional display device being located on the same support structure.

7. The apparatus of claim 5 further including at least one additional display device forming another portion of the graphic presentation arrangement for presenting the gaming result to the player, the at least one additional display device being located on an additional support structure that is rotatable with respect to the separate portion of the apparatus.

8. The apparatus of claim 5 wherein the display device encompasses multiple indicia locations on the support structure.

9. The apparatus of claim 5 wherein the display device encompasses an entire peripheral surface of the support structure.

10. The apparatus of claim 5 wherein the display device includes a flexible liquid crystal display.

11. A method including:

(a) rotating a first structure with respect to a gaming machine cabinet, the first structure having a first display device mounted thereon;

(b) carrying signals in a wireless fashion between the first structure and a stationary device located off of the first structure; and (c) driving the first display device with a first display device input to display at least one indicia, the first display device input being based on the signals carried in the wireless fashion between the first structure and the stationary device.

12. The method of claim 11 wherein driving the first display device further includes displaying moving indicia with the first display device.

13. The method of claim 11 further including driving the first display device to display two or more separate indicia, each separate indicia being located at a different respective indicia location on the first structure.

14. The method of claim 11 wherein the first structure includes a number of different indicia locations about the periphery of the first structure and further including driving the first display device to display a respective indicia at each indicia location.

15. The method of claim 11 further including:

(a) rotating a second structure with respect to the gaming machine cabinet, the second structure having a second display device mounted thereon;

(b) carrying signals in a wireless fashion between the second structure and the stationary device; and (c) driving the second display device with a second display device input to display at least one indicia, the second display device input being based on the signals carried in the wireless fashion between the second structure and the stationary device.

16. The method of claim 11 further including:

(a) rotating a third structure with respect to the gaming machine cabinet, the third structure having a third display device mourned thereon;

(b) carrying signals in a wireless fashion between the third structure and the stationary device; and (c) driving the third display device with a third display device input to display at least one indicia, the third display device input being based on the signals carried in the wireless fashion between the third structure and the stationary device.

* * * * *

UNITED STATES PATENT AND TRADEMARK OFFICE

CERTIFICATE OF CORRECTION

PATENT NO. : 7,166,029 B2
APPLICATION NO. : 10/985362
DATED : January 23, 2007
INVENTOR(S) : Joseph R. Enzminger It is certified that error appears in the above-identified patent and that said Letters Patent is hereby corrected as shown below:

At column 1, line 62:
Change “many modem slot machines,” to --many modern slot machines,--.

At column 8, line 45:
Change “device mourned thereon;” to --device mounted thereon;--.

Signed and Sealed this

Twentieth Day of March, 2007

JON W. DUDAS
*Director of the United States Patent and Trademark Office*